US006840194B2

(12) United States Patent
Young

(10) Patent No.: US 6,840,194 B2
(45) Date of Patent: Jan. 11, 2005

(54) ROUND PEN AND METHOD FOR INSTALLING THE SAME

(75) Inventor: Warren F. Young, Tulsa, OK (US)

(73) Assignee: Ranchers Pipe & Steel Corporation, Tulsa, OK (US)

( * ) Notice: Subject to any disclaimer, the term of this patent is extended or adjusted under 35 U.S.C. 154(b) by 0 days.

(21) Appl. No.: 10/608,302

(22) Filed: Jun. 30, 2003

(65) Prior Publication Data

US 2004/0139925 A1 Jul. 22, 2004

Related U.S. Application Data

(63) Continuation-in-part of application No. 10/345,461, filed on Jan. 17, 2003.

(51) Int. Cl.[7] ..... A01K 3/00; E04H 17/24

(52) U.S. Cl. ..... 119/513; 256/65.02

(58) Field of Search ..... 119/513, 502, 119/503, 504, 512, 514, 452, 473, 472, 474; 256/65.01, 65.02, 65.15, 39

(56) References Cited

U.S. PATENT DOCUMENTS

| | | | | |
|---|---|---|---|---|
| 349,377 A | | 9/1886 | White | |
| 603,157 A | * | 4/1898 | Spitzenberg | 256/39 |
| 2,139,642 A | | 12/1938 | Oslin | |
| 2,895,716 A | | 7/1959 | Veltri | |
| 5,063,876 A | * | 11/1991 | Harris | 119/513 |
| 5,794,990 A | * | 8/1998 | Coppedge | 292/153 |
| 5,967,089 A | * | 10/1999 | Allen | 119/474 |
| 6,349,924 B1 | * | 2/2002 | Studebaker et al. | 256/65.01 |

* cited by examiner

*Primary Examiner*—Yvonne R. Abbott
(74) *Attorney, Agent, or Firm*—William S. Dorman

(57) ABSTRACT

A round pen and the method of constructing the same which comprises the steps of selecting a plurality of vertical round tubular steel posts, a plurality of horizontal rails of tubular steel and a plurality of cables of sufficient length to traverse the distance from the first end post around the intermediate posts and back to the second end post, each intermediate post having a series of eyes welded thereon, fitting the cables through all of the eyes on the intermediate posts and attaching an end of each cable to the first end post, attaching an opposite end of each cable to the second end post through a spring, inserting an end of a horizontal rail into an opening in the first end post and then adjusting the opposite end of the rail into an opening in the next adjacent intermediate post, continuing to insert horizontal rails in all of the intermediate posts until the rails are in abutting relation in all of the intermediate posts, inserting the ends of a horizontal rail in an opening in the second end post and into an opening in the last intermediate post, inserting retaining pins within vertical holes located adjacent the ends of the rails within the intermediate posts to prevent the rails from slipping out of the intermediate rails, placing the cables under tension so that the rails are placed in compression between the posts, thereby preventing the pen from collapsing and providing rigidity for the pen structure.

6 Claims, 5 Drawing Sheets

Fig. 1
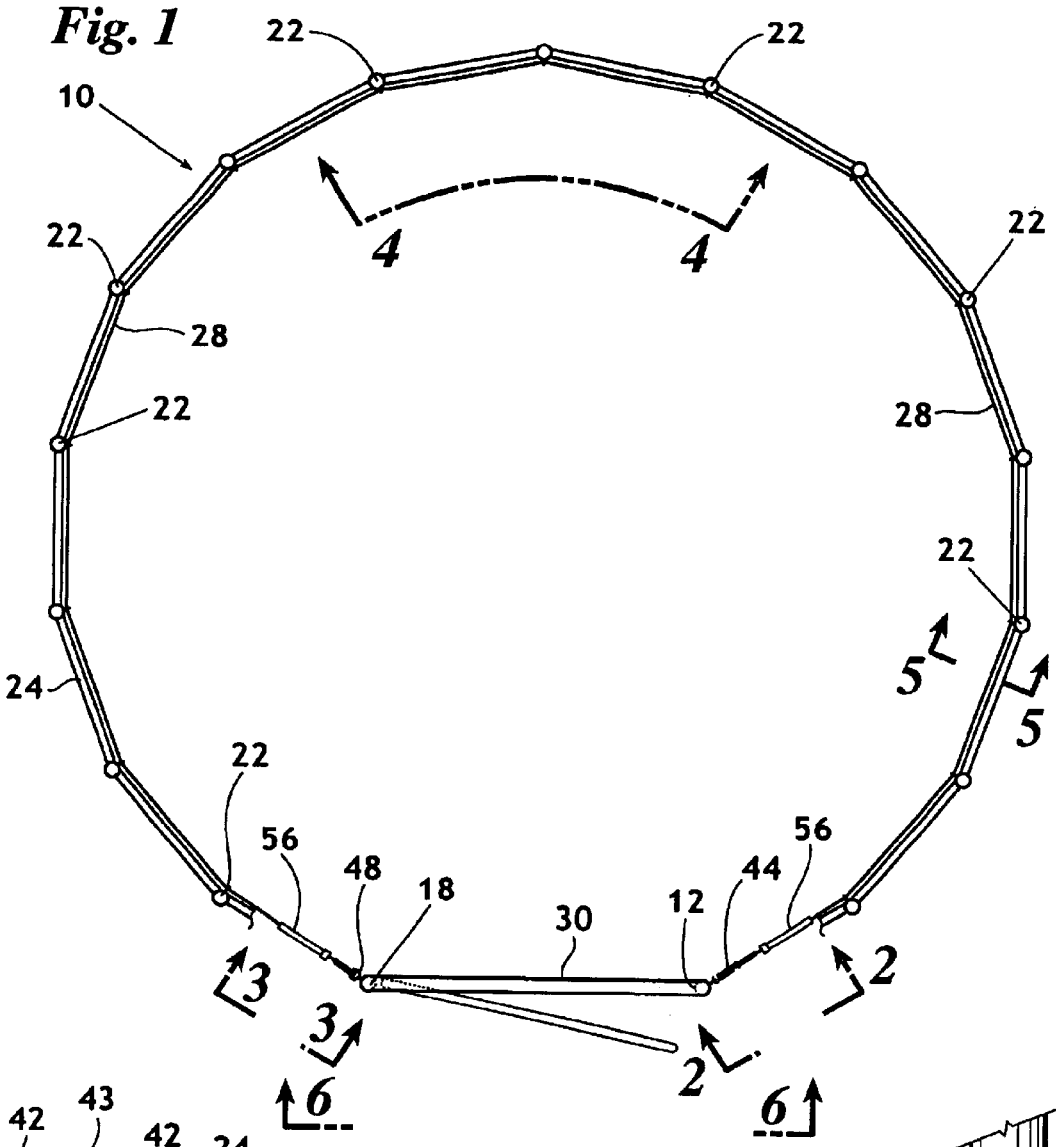
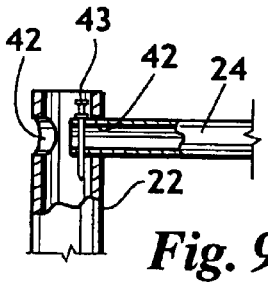
Fig. 9
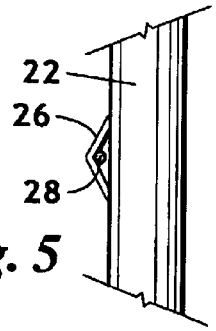
Fig. 5
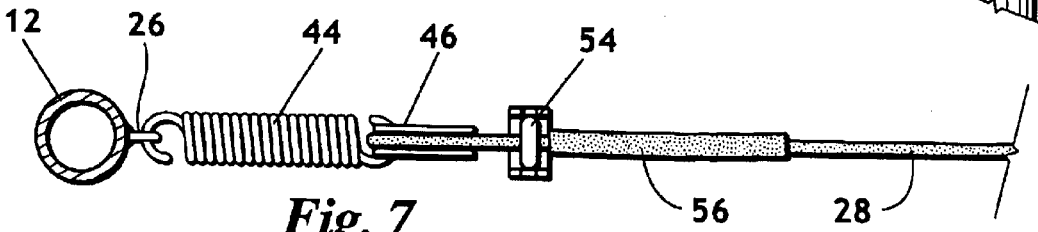
Fig. 7

ROUND PEN AND METHOD FOR INSTALLING THE SAME

CROSS-REFERENCE TO RELATED APPLICATIONS

This application is a continuation in part of prior copending application Ser. No. 10/345,461, filed Jan. 17, 2003, and entitled "Ranch Fence."

BACKGROUND OF THE INVENTION

1. Field of the Invention

The present invention relates to fencing for livestock and, more particularly, to a livestock pen preferably shaped in a circular disposition and to a method of making such a pen.

2. The Prior Art

The prior art discloses numerous patents involving round fencing systems, fencing systems for livestock, cable tensioning systems, tubular fence systems and the like. However, the prior art fails to disclose the essence of the present invention which involves a plurality of vertical round tubular steel posts with a horizontal top rail of tubular steel arranged in the form of a round or oval pen, each pen being provided with a first end post, a second end post and a plurality of intermediate posts; each intermediate post having a series of "eyes" welded thereon through which a cable may pass to connect the posts together. The number of eyes is proportional to the height of the pen. The first end post and the second end post may be longer than the intermediate posts to allow for the addition of a U-shaped connector bar to fit atop the end posts to connect the two posts together. The cables are placed under tension, giving tension along the entire circumference of the pen to place the upper horizontal rails and the U-shaped connecter bar under compression.

A preliminary search was conducted and the following listed patents were considered as broadly pertinent to the general subject matter.

| Patent No. | Inventor | Date |
|---|---|---|
| 2,139,642 | Osolin | December 6, 1938 |
| 2,895,716 | Veltri | July 21, 1959 |
| 349,377 | White | September 21, 1886 |

Osolin U.S. Pat. No. 2,139,642 discloses spring cable tensioners having rods contained therein to maintain tension, the rods comprising a bolt secured at each end, one end by the flat portion on the bolt, and the other end having a nut screwed thereon. The Osolin spring tensioners are designed primarily for use between posts in road blocks.

Veltri U.S. Pat. No. 2,895,716 discloses a spring that provides strand tension. However, the Veltri patent relates to sections of a fence, not a single tension cable which extends the length of the pen. Rather, Veltri consists of various sections of fence which may be adjustable in height to compensate for uneven terrain or bodies of water located along the fence perimeter.

White U.S. Pat. No. 349,377 discloses a wire fence having a cable tension structure which is broadly similar to that disclosed in the present application.

SUMMARY OF THE INVENTION

The present invention involves a round or oval pen designed primarily to enclose livestock such as horses or the like. The round pen consists primarily of a plurality of round vertical tubular steel posts provided with a rigid horizontal top rail, also of tubular steel. Each pen, more specifically, is provided with a first end post, a second end post, and a plurality of intermediate posts, each intermediate post having a series of "eyes" welded thereon through which cables may pass to connect the posts together in a circular array. The exact number of eyes (and hence cables) will depend upon the desired height of the pen. The end posts may be longer than the intermediate posts to allow for the addition of a U-shaped connector bar designed to fit over these end posts so that there is continuous tension over the entire circumference of the pen. A standard gate can be installed between the end posts.

When the pen is installed, the vertical steel posts will be spaced equi-distant from one another with their lower ends being received in suitable holes in the ground. One end of a horizontal top steel rail is then inserted all the way into a corresponding opening in the top of the first end post. Thereafter, the other end of this top rail is inserted into a similar opening in the next adjacent intermediate post; the rail is slid into the intermediate post far enough to keep it from slipping out. The inserted end of the rail is secured in position in the intermediate post by means of a retaining pin which is dropped down through the upper end of the intermediate post and into a drilled hole in the rail. This retaining pin, which could be a double headed nail, for example, may be removed when replacing bent or damaged top rails. The use of the retaining pins provides an orderly and systematic method of assembly of the pen.

This process is repeated for each horizontal rail until all are set, then the posts are secured in place in the ground with cement or similar substance. Alternatively, the posts can be set directly into the ground without cement, if the owner desires to move the pen from one place to another from time to time. The retaining pins prevent the rails from sliding backwards and being removed. As indicated above, the use of the retaining pins facilitates easy replacement of the top rails in the event that a rail is damaged, as it requires no welding or other "permanent" attachment of the rails to the posts. Each vertical post can be provided with a cap.

Once the top rails are installed, the cable connectors are installed by a attaching a multi coiled spring having a hook at each end thereof, first to an eye provided on the first end post and then to a curved metal guide (thimble) at the second end of the spring. The cable is then threaded through the thimble, with a remaining overlap of approximately 14" which overlapping portion is covered by a sliding sleeve and secured by a cable clamp. The remaining portion of the cable should be of sufficient length to traverse the circumference of the pen with excess for securing at the other end post. The cable is threaded through an eye on each intermediate post and, when the other end post is reached, it is threaded over another thimble provided with an eye-bolt. The eye-bolt is secured to the second end post by threading the bolt through the post and securing with a tension adjusting nut on the opposite side. The cable is then pulled tight with a tension tool and the tension is secured with a U clamp. The cable is then secured to itself via the same mechanism used above; i.e., the sleeve that covers the folded over portion of the cable to the cable itself.

The end result is a round or oval pen having a rigid horizontal top rail and a plurality of flexible horizontal cables which are spaced vertically and which create uniform tension along the pen's circumference. The flexible cable system is designed to be less damaging to an animal who gets a leg through the fence or who runs into the fence, and is designed such that any component which may become damaged can be easily replaced.

BRIEF DESCRIPTION OF THE DRAWINGS

FIG. 1 is a plan view of a livestock pen made in accordance with the present invention and showing a gate in a partly open position.

FIG. 5 is a sectional view on an enlarged scale along section line 5—5 of FIG. 1 showing how the cable passes through one of the eyes secured to an intermediate post.

FIG. 7 is a vertical sectional view taken along section line 7—7 of FIG. 2 showing the details of connecting means employed with one of the cables and the first end post.

FIG. 9 is a fragmentary sectional view of the upper end of the intermediate post to the left of the second end post, also showing the end of the top rail and its retaining pin.

DETAILED DESCRIPTION OF THE DRAWINGS

Figure 6:
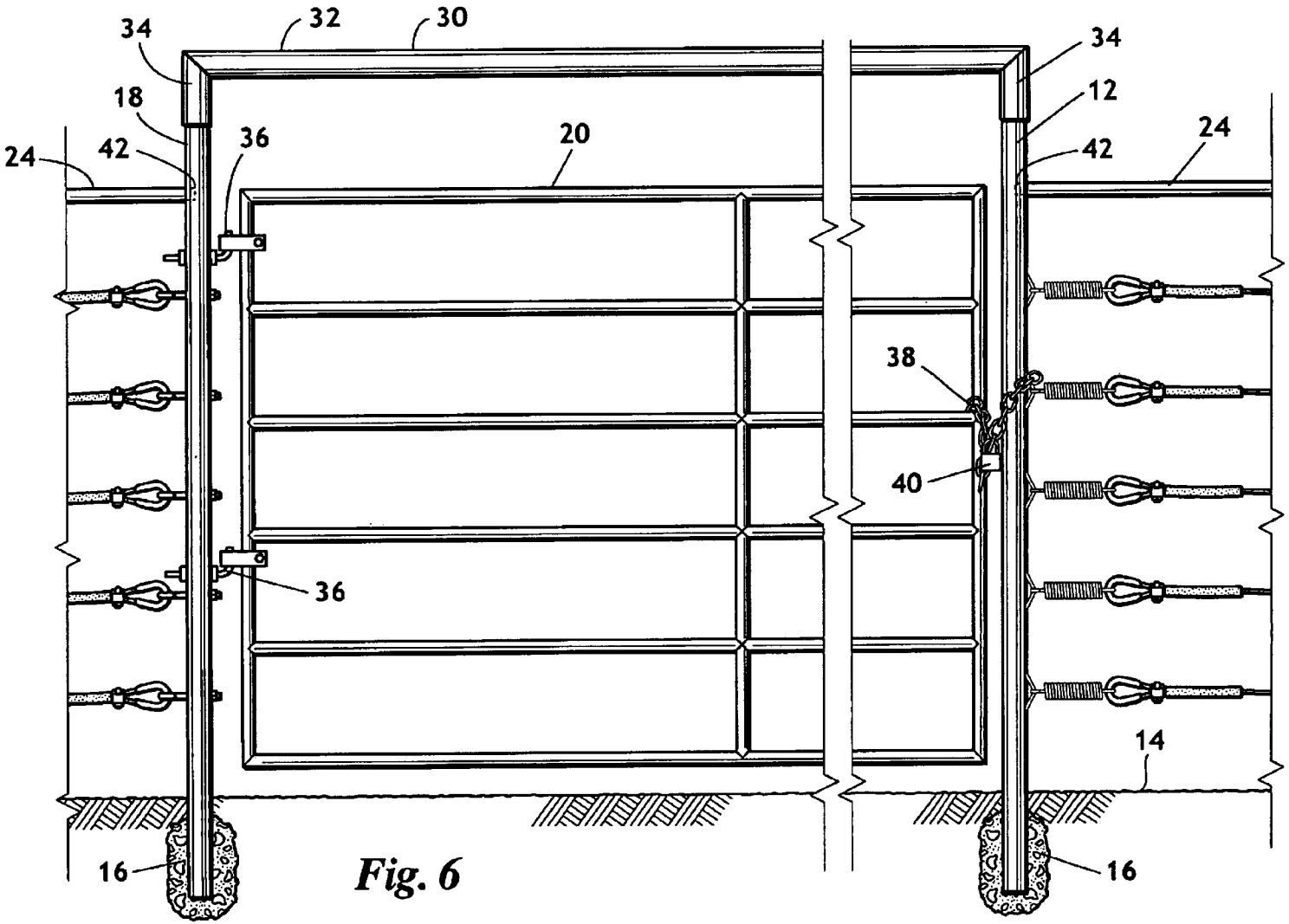
FIG. 6 is a front elevation on an enlarged scale of the gate and the two main posts as viewed along line 6—6 of FIG. 1.

Referring to the drawings in detail, FIGS. 1 and 6 show a round pen 10 for livestock such as cattle and horses. The pen consists of a first vertical post 12 suitably secured in the ground 14 by means of cement 16 or the like. A second end post 18 is mounted in spaced parallel relation with the first post 12 and is similarly secured in the ground by means of cement 16. A swingable gate 20 is mounted between the two posts 12 and 18 to permit entry into the round pen 10 and also to permit the pen to be closed when the gate 20 is closed.

Figure 4:
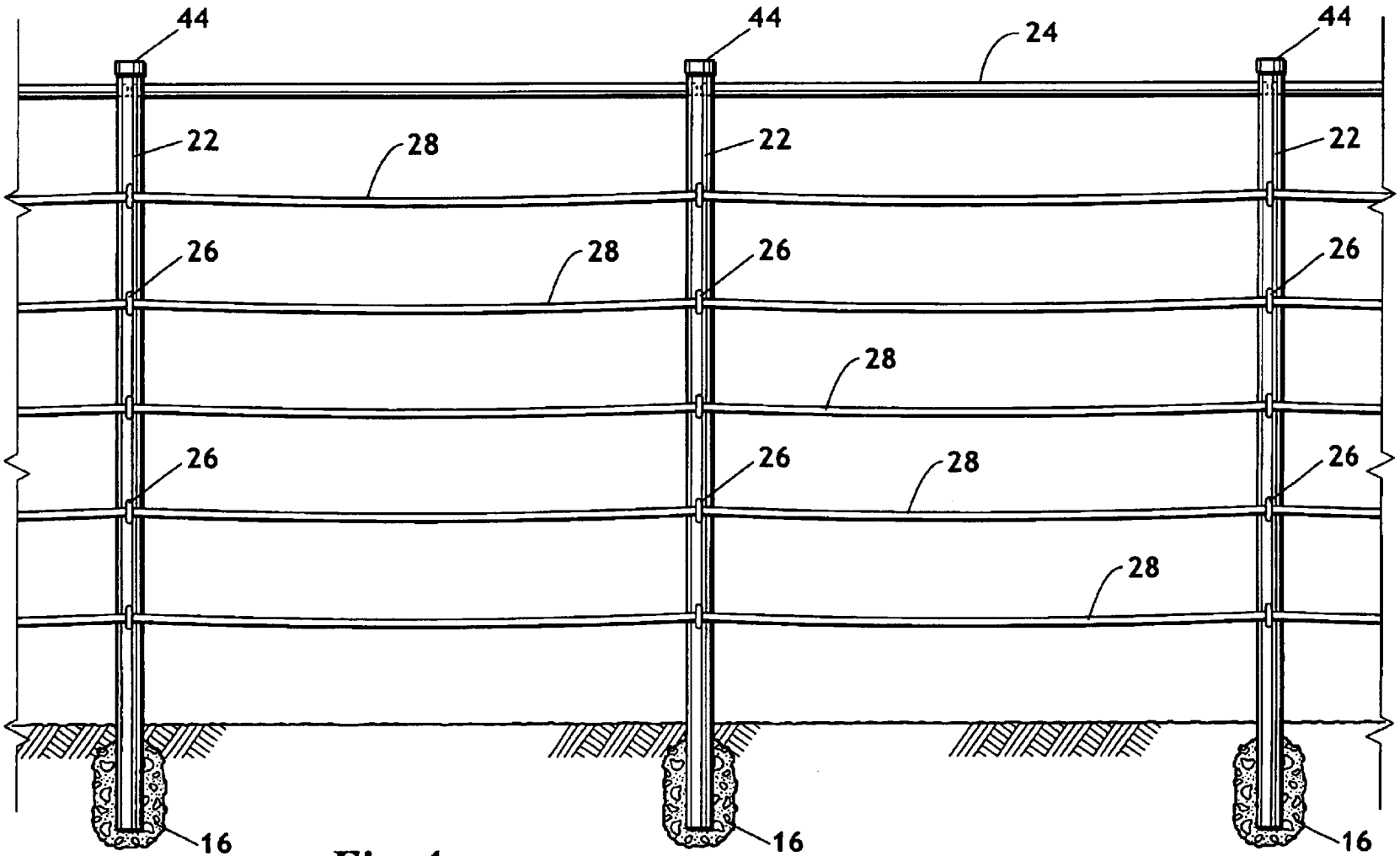
FIG. 4 is a partial elevation taken along line 4—4 of FIG. 1 showing three adjacent intermediate posts with the upper steel rail and five lower cable rails attached.

The pen 10 also includes a plurality of intermediate vertical posts 22 (see now FIG. 4). The posts 12 and 18 and the intermediate posts 22 are all round tubular steel posts. The space between each pair of adjacent posts is spanned by a horizontal top rail 24 of tubular steel. Each horizontal rail is provided with a vertical hole(s) adjacent each end to receive a retainer pin therein, as will hereinafter appear. Each intermediate post 22 is provided with a plurality of steel eyes 26 arranged vertically along the height of each intermediate post 22 and welded thereto. The eyes 26 permit a plurality of flexible cables 28 to pass horizontally through all of the eyes of all of the intermediate posts and to be placed under tension as will hereinafter appear. The exact number of eyes 26 (and cables 28) will depend upon the desired height of the pen. In this particular case five such cables 28 are shown.

The first end post 12 and the second end post 18 may be longer (higher) than the intermediate posts to allow for the addition of a U-shaped connector bar 30 The connector bar 30 has a top horizontal hollow steel member 32 and two vertical tubes 34 welded at right angles to the ends of the horizontal member 32 The vertical tubular members 34 are slightly larger in internal diameter than the outer diameter of the posts 12 and 18 so that they can fit over these posts so as to connect these two posts together. Thus, the cables 28 and the U-shaped connector 30 are all under continuous tension along the entire circumference of the pen, as will hereinafter appear. The top rails 24, on the other hand, are under continuous compression.

A standard gate 20 is connected in any convenient manner to the posts 12 and 18. For example, a pair of hinge members 36 connect the left-hand end of the gate 20 to the second end post 18 for pivotal movement with respect thereto. The right-hand side of the gate can be secured to the first post 12 by means of a chain 38 and padlock 40, or by any other convenient locking manner. When the pen 10 is installed, the posts 12, 18 and 22 are preferably spaced equi-distant from each other. The top rail 24 (made of tubular steel) is then inserted into a corresponding opening 42 in the second end post 18. (The following sequence would be reversed if we started from the first end post 12). The right end of the top rail 24 slides completely into the post 18 so that the left end end thereof is opposite the opening 42 in the next adjacent intermediate post 22. Thereafter, the top rail 24 is slid to the left so that the left hand end goes into the opening 42 of the intermediate post 22 as will appear from a consideration of FIG. 9. A retaining pin (or nail) 43 is dropped into the upper end of the intermediate post 22 and into a hole (not referenced) located adjacent the left hand end of the rail 24 to keep the rail from slipping out of the post as shown in FIG. 9.

Each intermediate post, as well as the end posts 12 and 18, is provided with a hole 42 of sufficient size to accommodate the end of the top rail 24. It should be understood that each hole 42 is of sufficient size to accommodate the rail with sufficient clearance for the rail to cant in the event that the pen traverses uneven ground. The process of inserting the top rail 24 into the intermediate rails is repeated for each rail until all are set. Then the posts are secured in place (in the ground) with cement or similar substance. Alternatively, the posts can be set directly into the ground without cement if the owner desires to move the pen from one place to another from time to time. Once the posts have been set, the cables are tensioned, as will be explained hereinafter, and the top rails slide toward each such that they abut each other at the center of each post. This tensioning of the cables produces a corresponding compression of all of the top rails 24 so as to provide sufficient rigidity and to prevent the pen 10 from collapsing.

The method of installing the top rails facilitates easy replacement of these top rails in the event that a rail is damaged, as it requires no welding or other "permanent" attachment of the rails to the posts. Each post 22 can be provided with a cap 44 to cover the upper ends of the intermediate posts 22.

The first end post 12 has a plurality of eyes 26 similar to, or the same as, the eyes 26 which are attached to the intermediate posts 22 The cables 28 are preferably flexible steel cables covered with rubber or plastic coating. These cables are extremely strong and extend from the first end post 12 through the eyes 26 of the intermediate posts 22 and back to the end post 18. At the location of the first post 12, the cables 28 connect to the post 12 by means of a plurality of multi-coiled springs 44. Each spring has a hook at the left-hand end which fits into the eyes 26 on the end post 12 and another hook at the opposite end which fits into a curved metal guide (cable thimble) 46 around which the cable 28 extends. The other end of the cable 28 connects with the end post 18 through a series of eye-bolts 48 and a plurality of cable thimbles 46 around which the cable 28 is wound. The thimble 46 is inserted into the eye of the eye-bolt 48 before the cable 28 is wound around the thimble. The opposite end of the eye-bolt 48 is secured by means of a tension adjusting nut 50.

Figure 3:
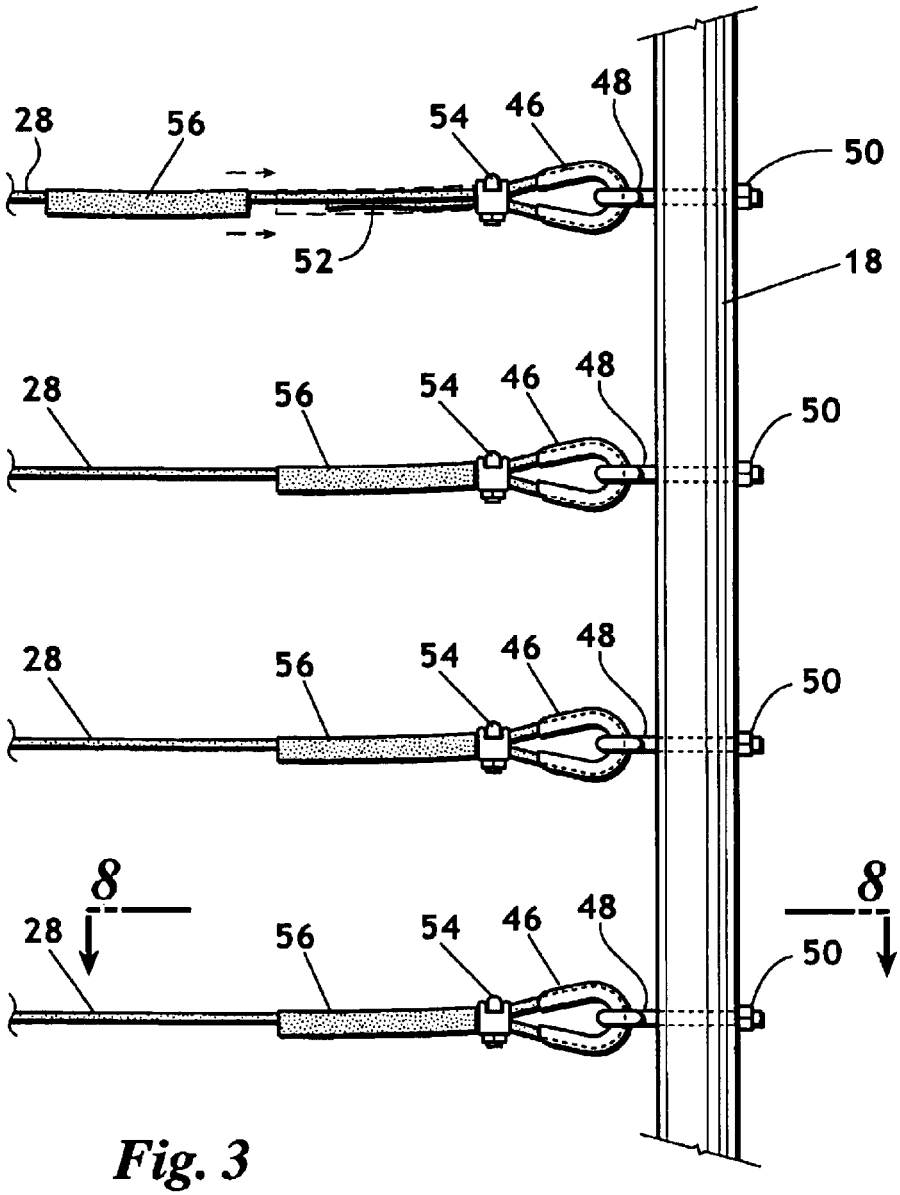
FIG. 3 is a view similar to FIG. 2, taken along line 3—3 of FIG. 1 showing the connection of the cables to the other end post.

When desiring to tighten the cable 28 around the entire pen, the free end 52 of the cable 28 is grasped or engaged by a cable tensioning tool (not shown), sometimes know as a "come-along" (or equivalent tensioning device) to pull the end 52 in a left-hand direction, for example, with respect to FIG. 3. After the desired pull is reached, then the end 52 of the cable is secured against the remainder of the cable by means of a U-shaped clamp 54 which is tightened in a conventional manner. During the use of the cable tensioning tool, the end 52 is pulled in a maximum direction towards the left. When this maximum pull has been achieved and the clamp 54 has been tightened, then a flexible sleeve 56 made of rubber or plastic material is inserted over the free end 52 of the cable 28 so that the cable 28 and its end 52 are fully enclosed within the sleeve 56 as shown in lower portions of FIG. 3.

Figure 2:
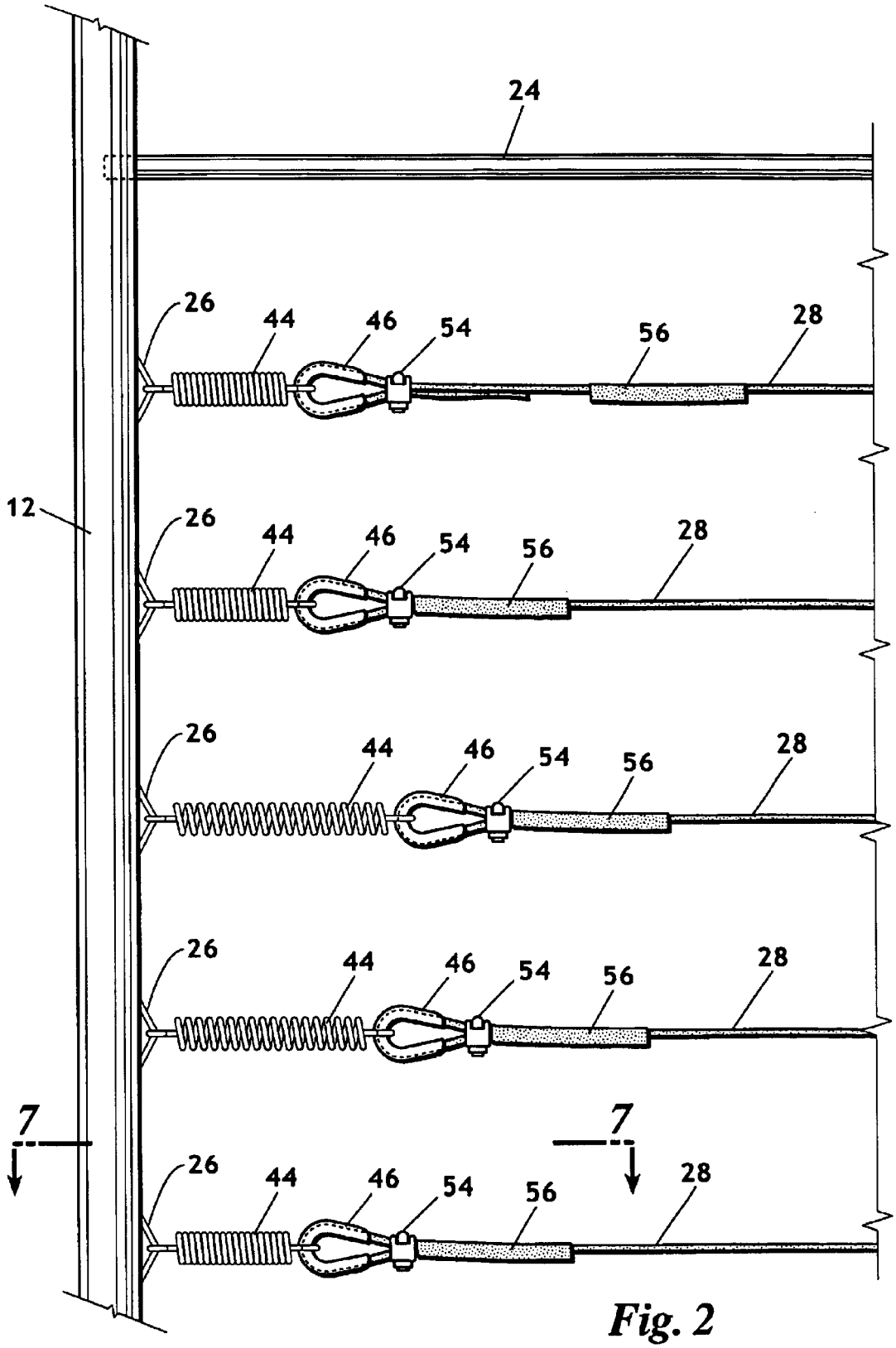
FIG. 2 is a partial elevation on an enlarged scale of one end post and associated cables taken along line 2—2 of FIG. 1 and showing some of the springs in an expanded condition.

Although the cable 28 is preferable pulled with respect to the end post 18, attention is directed to FIG. 2 wherein the other end of the cable similarly engages a cable thimble 46 such that a free end 52 of the cable is provided at the other end of the cable. The free end 52 is secured to the cable 28 itself by means of a U-shaped clamp 54 and the exposed end of the cable 52 is covered by a slidable sleeve 56 which is slide toward the left as it relates to FIG. 2. As shown in the bottom portion of FIG. 2, the spring 44 can be expanded depending upon the force exerted on the cable 28

Figure 8:
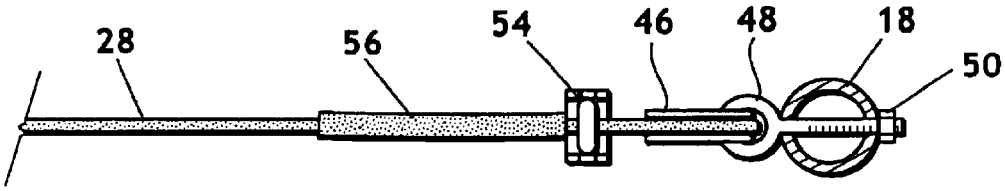
FIG. 8 is a vertical sectional view taken along section line 8—8 of FIG. 3 showing the details of connecting means employed with one of the cables and the second end post.

As best shown in FIGS. 3 and 8, the eye-bolts 48 and the tension adjusting nuts 50 represent the "fine tuning" of the tensioning process. It should be further understood that the threaded shank of the eye-bolt 48 would be normally longer than that shown in FIGS. 3 and 8 so that the eye of the bolt would be spaced further to the left than as shown. Thus, the final increase in tension could be provided by turning the tension adjusting nut 50 to bring the "eye" closer to the post 18 and increase the tension in the cable 28 It might be necessary to make such slight adjustments from time to time to compensate for changes in cable tension resulting from weather changes or to assure proper cable tension to help prevent injury to the livestock. Following the fine tuning with the tension adjusting nut 50, it may be necessary to cut off any excess of the extended threaded shaft of the eye bolt 48.

Whereas the present invention has been described in particular relation to the drawings attached hereto, it should be understood that other and further modifications, apart from those shown or suggested herein may be made within the spirit and scope of this disclosure. Also, this invention should not be considered as limited by reference to specific details such as sizes, shapes, types of materials employed, etc. Suffice it to say that modifications that operate in the same manners as the preferred embodiments disclosed herein fall within the purview of this invention. The cables disclosed should be sufficiently strong to accommodate the tensions likely to be realized in a pen of the type designed to enclose livestock but at the same time should be sufficiently flexable to prevent or minimize injury to livestock when the latter come in contact therewith.

The top rails should be sufficiently strong to provide the rigidity desired as well as undergo and withstand the compressive forces to which they are subjected when the cables are tensioned. The post should be sufficiently rugged to withstand tensile, compressive and shear forces from the interconnecting elements.

What is claimed is:

1. A round pen comprising a plurality of vertical round tubular steel posts provided with a plurality of horizontal top rails of tubular steel, the steel posts including a first end post, a second end post and a plurality of intermediate posts, each intermediate post having a series of "eyes" welded thereon through which cables may pass to connect the posts, the posts being spaced equal distance from one another in a circular or oval arrangement and having lower ends secured in the ground, a top horizontal tubular steel rail extending from the first end post to the next adjacent intermediate post and a top horizontal tubular steel rail extending between each pair of intermediate posts around the circumference of the pen until a top rail extends from the last intermediate post into the second end post, the top rails having ends abutting each other within each of the intermediate posts, the top rails being provided with retaining pins inserted within vertical holes located adjacent the ends of the rails within the intermediate posts to prevent the rails from slipping out of the intermediate rails, a plurality of cables extending through the eyes of all the intermediate posts and being connected at one end to the first end post and at another end to the second end post, and means for tensioning the cables to place the rails in compression and add rigidity to the round pen.

2. A round pen as set forth in claim 1 wherein each of the steel posts includes an upper end and a lower end, the upper end of all of the intermediate posts being covered with caps, the lower ends of all the posts being embedded in the ground.

3. A round pen as set forth in claim 1 wherein all of the posts are provided with upper and lower ends, the lower ends of the posts being embedded in the ground and surrounded by concrete, a U-shaped connector connecting from the top of the first end post to the top of the second end post, the U-shaped connector consisting of a horizontal tubular member having a length equal to the distance between the first and second end posts and being provided with a pair of vertical tubes connected at right angles to the ends of the horizontal member, the vertical tubes having an inner diameter slightly larger than the external diameter of the end posts.

4. A round pen as set forth in claim 1 wherein the cables are connected to the first end post through a plurality of springs.

5. A method for installing a round pen in the ground which comprises the steps of selecting a plurality of vertical round tubular steel posts, the steel post including a first end post, a second end post and a plurality of intermediate posts, a plurality of horizontal rails of tubular steel and a plurality of cables of sufficient length to traverse the distance from the first end post around the intermediate post and back to the second end post, each intermediate post having a series of eyes welded thereon, fitting the cables through all of the eyes on the intermediate posts and attaching an end of each cable to the first end post, attaching an opposite end of each cable to the second end post through a spring, inserting an end of a horizontal rail into an opening in the first end post and then adjusting the opposite end of the rail into an opening in the next adjacent intermediate post, continuing to insert horizontal rails in all of the intermediate posts until the rails are in abutting relation in all of the intermediate posts, inserting the ends of a horizontal rail in an opening in the second end post and into an opening in the last intermediate post, inserting retaining pins within vertical holes located adjacent the ends of the rails within the intermediate posts to prevent the rails from slipping out of the intermediate rails, placing the cables under tension so that the rails are placed in compression between the posts.

6. A method of installing a round pen in the ground as set forth in claim 5 including the additional step of placing a U-shaped connector over the ends of the first and second end posts, the U-shaped connector consisting of a horizontal tubular steel member having a length approximately equal to the distance between the first and second end posts and a pair of vertical tubular members welded at right angles to the end of the horizontal member, the vertical tubular members having an inn diameter slightly in excess of the external diameter of the end posts so that they fit over the posts and whereby the U-shaped connector is placed intension when the cable are in tension.

* * * * *